US011407082B2

(12) United States Patent
Shi

(10) Patent No.: US 11,407,082 B2
(45) Date of Patent: Aug. 9, 2022

(54) METHOD AND SYSTEM FOR MONITORING POLISHING PAD

(71) Applicants: Semiconductor Manufacturing International (Beijing) Corporation, Beijing (CN); Semiconductor Manufacturing International (Shanghai) Corporation, Shanghai (CN)

(72) Inventor: Chao Shi, Tianjin (CN)

(73) Assignees: Semiconductor Manufacturing International (Beijing) Corporation, Beijing (CN); Semiconductor Manufacturing International (Shanghai) Corporation, Shanghai (CN)

( * ) Notice: Subject to any disclaimer, the term of this patent is extended or adjusted under 35 U.S.C. 154(b) by 944 days.

(21) Appl. No.: 16/185,653

(22) Filed: Nov. 9, 2018

(65) Prior Publication Data

US 2019/0076982 A1 Mar. 14, 2019

Related U.S. Application Data

(62) Division of application No. 15/262,817, filed on Sep. 12, 2016, now Pat. No. 10,155,296.

(30) Foreign Application Priority Data

Dec. 8, 2015 (CN) ..... 201510898297.2

(51) Int. Cl.
*B24B 37/013* (2012.01)
*B24B 37/20* (2012.01)
(Continued)

(52) U.S. Cl.
CPC ..... *B24B 37/013* (2013.01); *B24B 37/005* (2013.01); *B24B 37/20* (2013.01);
(Continued)

(58) Field of Classification Search
CPC ..... B24B 37/005; B24B 37/013; B24B 37/20; B24B 37/22; B24B 37/26; B24D 11/00; B24D 18/0045; B24D 2205/00
See application file for complete search history.

(56) References Cited

U.S. PATENT DOCUMENTS 4,226,274 A 10/1980 Awaya et al.
5,736,427 A 4/1998 Herderson
(Continued)

FOREIGN PATENT DOCUMENTS

CN 1480991 A 3/2004
CN 201848764 U 6/2011

*Primary Examiner* — Joel D Crandall
(74) *Attorney, Agent, or Firm* — Anova Law Group, PLLC

(57) ABSTRACT

Method and system for monitoring a polishing pad is provided. The polishing pad includes a bottom layer, a polishing layer disposed on the bottom layer, and a plurality of mark structures disposed on the bottom layer and in the polishing layer to have a top surface coplanar with the polishing layer to indicate consumption level of the polishing layer. The monitoring system includes an acquisition module, a memory module, and a determining module connected to both the acquisition module and the memory module. The determining module, the acquisition module, and the memory module are configured to monitor the consumption level of the polishing layer and to recognize that the polishing pad needs to be replaced.

20 Claims, 6 Drawing Sheets

(51) Int. Cl.

| | |
|---|---|
| ***B24B 37/22*** | (2012.01) |
| ***B24B 37/26*** | (2012.01) |
| ***B24B 49/12*** | (2006.01) |
| ***B24B 37/005*** | (2012.01) |

(52) U.S. Cl.
CPC ..... *B24B 37/22* (2013.01); *B24B 37/26* (2013.01); *B24B 49/12* (2013.01); *B24D 2205/00* (2013.01)

(56) References Cited

U.S. PATENT DOCUMENTS

| | | | | |
|---|---|---|---|---|
| 5,913,713 | A * | 6/1999 | Cheek | B24B 37/26 451/41 |
| 6,090,475 | A | 7/2000 | Robinson et al. | |
| 6,106,661 | A * | 8/2000 | Raeder | B24B 37/26 156/345.12 |
| 6,136,043 | A | 10/2000 | Robinson et al. | |
| 6,331,137 | B1 * | 12/2001 | Raeder | B24B 37/26 451/285 |
| 6,652,764 | B1 * | 11/2003 | Blalock | B24B 37/26 216/88 |
| 2002/0083577 | A1 * | 7/2002 | Suzuki | B24B 37/26 29/603.16 |
| 2002/0182986 | A1 | 12/2002 | Tung et al. | |
| 2003/0040260 | A1 | 2/2003 | Andres | |
| 2004/0033760 | A1 | 2/2004 | Osterheld | |
| 2013/0237136 | A1 | 9/2013 | Newell et al. | |
| 2016/0107381 | A1 * | 4/2016 | Krishnan | B24B 37/24 451/527 |
| 2017/0133252 | A1 | 5/2017 | Fung et al. | |
| 2020/0030933 | A1 * | 1/2020 | Cui | B24B 37/22 |

* cited by examiner

METHOD AND SYSTEM FOR MONITORING POLISHING PAD

CROSS-REFERENCES TO RELATED APPLICATIONS

This application is a divisional of U.S. patent application Ser. No. 15/262,817, filed on Sep. 12, 2016, which claims the priority of Chinese Patent Application No. CN201510898297.2, filed on Dec. 8, 2015, the entire content of which is incorporated herein by reference.

FIELD OF THE DISCLOSURE

The present disclosure generally relates to the field of semiconductor technology and, more particularly, relates to methods and systems for monitoring a polishing pad.

BACKGROUND

Chemical mechanical grinding is also known as chemical mechanical planarization or chemical mechanical polishing (CMP). During semiconductor manufacturing process, surface planarization is an important technique for processing high density photolithography. In the process of surface planarization, controlling the uniformity of the wafer surface is very important because only a planarized surface without height variation may avoid scattering of light during the exposure process. In addition, uniformity of wafer surface may also affect electrical parameters of electronic devices. Specifically, uneven thickness of a wafer may lead to variation in the performance of the devices that are ultimately formed on the same wafer, thus may affect product yield.

With the development of semiconductor manufacturing technology, CMP is regarded as the only processing technology at present that can provide both global and local planarization. The CMP technology has been widely used to remove and planarize interlayer dielectric layer, metal layer (such as tungsten plug, copper connection line, etc.), and shallow trench isolation structure, etc. The CMP technology has become one of most rapidly developed technologies for semiconductor manufacturing processes.

FIG. 1 shows a schematic view of an existing chemical mechanical polishing apparatus.

Referring to FIG. 1, the chemical mechanical polishing apparatus may include a polishing platen 01 and a polishing pad 11 placed on the surface of the polishing platen 01. The chemical mechanical polishing apparatus may also include a wafer holder 02 to hold a wafer S which needs to be planarized. The chemical mechanical polishing apparatus may further include a dropper 30 to introduce polishing fluid 31. The wafer holder 02 and the dropper 30 may both be disposed above the polishing platen 01.

The wafer S to be planarized may be held on the surface of the wafer holder 02. The surface of the wafer S to be polished may face to the polishing platen 01 and may be in contact with the polishing pad 11. The wafer holder 02 may ensure that the wafer S is pressed against the surface of the polishing pad 11.

During the chemical mechanical polishing process, relative movement between the wafer holder 02 and the polishing platen may be achieved by driving the wafer holder 02 and/or the polishing platen 01. In the meantime, the dropper 30 may introduce more polishing fluid 31 onto the surface of the polishing pad 11. Therefore, utilizing the relative movement between the polishing pad 11 and the surface of the wafer S as well as the chemical reaction between the polishing fluid 31 and the surface material of the wafer S, a portion of the surface material to be polished may be removed so that the surface to be polished may be planarized.

As described above, the polishing pad may be directly in contact with the wafer, thus the properties of the polishing pad may directly affect the performance of the wafer polishing process. Moreover, the polishing pad is a consumable component in the chemical mechanical polishing apparatus. That is, each polishing pad may have a service lifetime. However, precisely determining the service lifetime of polishing pads fabricated by existing methods may be very difficult, thus the quality of polished wafers may be affected when the service lifetime is not properly determined.

The disclosed polishing pad, monitoring method, and monitoring system are directed to solve one or more problems set forth above and other problems in the art.

BRIEF SUMMARY OF THE DISCLOSURE

One aspect of the present disclosure includes a polishing pad. The polishing pad includes a bottom layer, a polishing layer disposed on the bottom layer, and a plurality of mark structures disposed on the bottom layer and in the polishing layer to have a top surface coplanar with the polishing layer to indicate consumption level of the polishing layer.

Another aspect of the present disclosure provides a method for monitoring a polishing pad. The method includes providing a polishing pad which includes a polishing layer disposed on a bottom layer, and a plurality of mark structures disposed on the bottom layer and in the polishing layer to have a top surface coplanar with the polishing layer to indicate consumption level of the polishing layer, wherein the plurality of mark structures are configured to include mark patterns. The method for monitoring the polishing pad further includes acquiring label graphs of the plurality of label structures and comparing each mark pattern with a pre-stored critical pattern to obtain the consumption level of the polishing layer in a region adjacent to the mark structure corresponding to the mark pattern, wherein the critical pattern is the mark pattern of a corresponding mark structure when the polishing layer is worn out. The method for monitoring the polishing pad also includes recognizing that the polishing layer adjacent to a mark structure is worn out every time when the mark pattern is identical to the corresponding critical pattern, and adding one into a counting number, wherein the counting number is used to count the times that mark patterns match with corresponding critical patterns. Finally, the method for monitoring the polishing pad includes recognizing that the polishing pad needs to be replaced when the counting number reaches a preset value.

Another aspect of the present disclosure provides a monitoring system for monitoring a polishing pad. The monitoring system includes an acquisition module. The acquisition module is used to acquire mark patterns of a plurality of mark structures disposed on a polishing pad, wherein the polishing pad includes a polishing layer disposed on a bottom layer, and the plurality of mark structures disposed on the bottom layer and in the polishing layer to have a top surface coplanar with the polishing layer to indicate consumption level of the polishing layer; in addition, the plurality of mark structures are configured to include mark patterns. The monitoring system further includes a memory module. The memory module is used to store critical patterns and a preset value, wherein each critical pattern is the mark pattern of the corresponding mark structure when the polishing pad is worn out while the preset value is the number of times that mark patterns match with the corresponding critical patterns when the polishing pad is worn out. The monitoring system also includes a determining module. The determining module is connected to the acquisition module and the memory module, wherein the determining module, together with the acquisition module and the memory module, are configured to compare the acquired mark patterns with the corresponding critical patterns, calculate the number of times that the critical patterns match the mark patterns, compare the preset value with the number of times that the critical patterns match with the mark patterns, and further recognize that the polishing pad needs to be replaced when the number of times that the critical patterns match with the mark patterns reaches the preset value.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
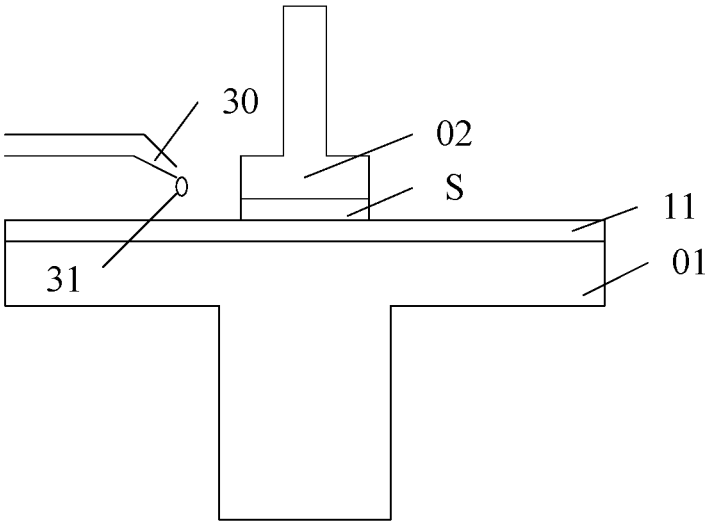
FIG. 1 (Prior Art)
FIG. 1 illustrates a schematic view of an existing chemical mechanical polishing apparatus.

FIG. 1 shows a schematic view of an existing chemical mechanical polishing apparatus. Polishing pads fabricated by existing methods may be used in the chemical mechanical polishing apparatus. However, a problem may widely exist in such polishing pads fabricated by existing methods. Specifically, the service lifetime of the polishing pads may not be precisely determined. In the following, an example will be provided to further illustrate the problems in determining the service lifetime of existing polishing pads. Specifically, challenges associated with the structure and the use of the polishing pads will be explained.

Figure 2:
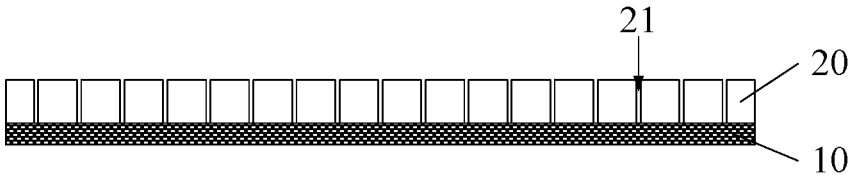
FIG. 2 (Prior Art)
FIG. 2 illustrates a schematic view of an existing polishing pad.

FIG. 2 shows a schematic view of an existing polishing pad. Referring to FIG. 2, the polishing pad may include a bottom layer 10 and a polishing layer 20 disposed on the surface of the bottom layer 10. A plurality of trenches 21 may be formed in the polishing layer 20. Polishing fluid may be distributed on the surface of the polishing layer 20 through the plurality of trenches 21. During a chemical mechanical polishing process using the polishing pad, the polishing layer 20 may become thinner due to consumption. Therefore, the polishing pad is a consumable component in the polishing process and each polishing pad may have a certain service lifetime.

In current technology, the service lifetime of polishing pads may be directly provided by the vendor or be determined by experiments.

For example, a method to experimentally determine the service lifetime of polishing pads may be an offline marathon test. The service lifetime of polishing pads may then be determined by the data collected during the offline marathon test. In this method, a new polishing pad is usually used to perform chemical mechanical polishing processes on a large number of wafers. As the service time of the polishing pad increases, the wafer removal rate may be monitored. The wafer removal rate monitoring may include inspection on removal rate profile, removal rate uniformity, and particle count.

After using the polishing pad for a certain period of time, the trenches formed on the surface of the polishing pad may be examined. The depth of the trenches formed on the polishing pad may be inspected by a professional measurement tool. Using such a method, a maximum service time of the polishing pad may be obtained and a safe service time may then be defined based on the experiences.

However, in practical applications, the service lifetime of polishing pads may be related to the specific procedure of the polishing process. The service lifetime of polishing pads may vary due to different materials and/or different processing procedures. Therefore, the service lifetime of polishing pads may be overestimated or underestimated. In particular, during an actual polishing process using a polishing pad, a problem emerging frequently is that the polishing pad may be completely worn out. That is, before the polishing time even reaches the preset service lifetime, the trenches on the surface of the polishing pad may have already been completely worn out. In some cases, when the actual service time of the polishing pad only reaches 66% of the preset service time, the trenches have already been worn out.

Because existing methods may not be able to precisely detect the wear condition of the surface of a polishing pad, a proper service time may not be well defined. Therefore, improving the performance of formed semiconductor devices may be very difficult while reducing product cost may also face a challenge.

The present disclosure provides a polishing pad. FIGS. 3-7 show schematic views of an exemplary polishing pad consistent with disclosed embodiments.

Figure 3:
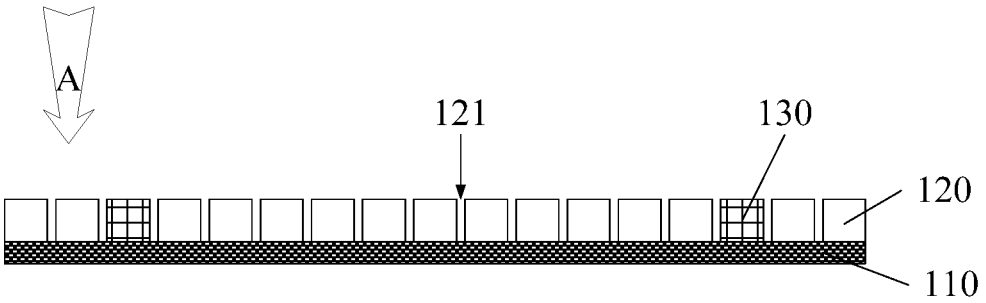
FIGS. 3-7 illustrate schematic views of an exemplary polishing pad consistent with disclosed embodiments.

Referring to FIG. 3, the polishing pad may include a bottom layer 110 and a polishing layer 120 disposed on the surface of the bottom layer 110.

The bottom layer 110 may serve as an interface layer connecting the polishing pad with the chemical mechanical polishing equipment. In one embodiment, the bottom layer 110 may be made of a soft material. In addition, soft fluff may be disposed on the surface of the polishing layer 120. The soft fluff may work together with polishing fluid to achieve wafer polishing. In one embodiment, the polishing layer 120 may be made of a hard material.

The polishing pad may also include a plurality of mark structures 130 formed in a same layer as the polishing layer 120 formed and used to indicate the consumption level of the polishing layer 120.

During the chemical mechanical polishing process, friction between the polishing layer 120 and the wafer surface to be polished may be created. Therefore, the polishing layer 120 may become thinner due to consumption during the polishing process. However, because the polishing layer 120 may be directly in contact with the wafer, the properties of the polishing layer 120 may directly affect the quality of the chemical mechanical polishing process. Therefore, when the consumption of the polishing layer 120 reaches a certain level, the polishing pad may need to be replaced in order to improve the quality of the chemical mechanical polishing process. The plurality of mark structures 130 may be used to indicate the consumption level of the polishing layer 120.

In one embodiment, the top surfaces of the plurality of mark structures 130 may be leveled with the surface of the polishing layer 120 in order to precisely indicate the consumption level of the polishing layer 120. Therefore, as the polishing layer 120 is gradually worn out during the polishing process, the mark structures 130 may also be consumed so that the mark structures 130 may indicate the consumption level of the polishing layer 120.

Further, in one embodiment, the plurality of mark structures 130 and the polishing layer 120 may be made of a same material. Therefore, the mark structures 130 and the polishing layer 120 may demonstrate same conditions such as hardness. During the polishing process, the consuming rate of the mark structures 130 may be the same as the consuming rate of the polishing layer 120. Therefore, by using the mark structures 130 to indicate the consumption level of the polishing layer 120, the service lifetime of the polishing pad may be determined more precisely.

In one embodiment, the plurality of mark structures 130 and the polishing layer 120 may be simultaneously formed. In other embodiments, the plurality of mark structures 130 and the polishing layer 120 may be formed separately. Specifically, the plurality of mark structures 130 may be formed as independent modules. During the process to form the polishing layer 120, modules corresponding to the plurality of mark structures 130 may be directly added into the polishing layer 120 so that the plurality mark structures 130 may be embedded into the polishing layer 120.

Figure 4:
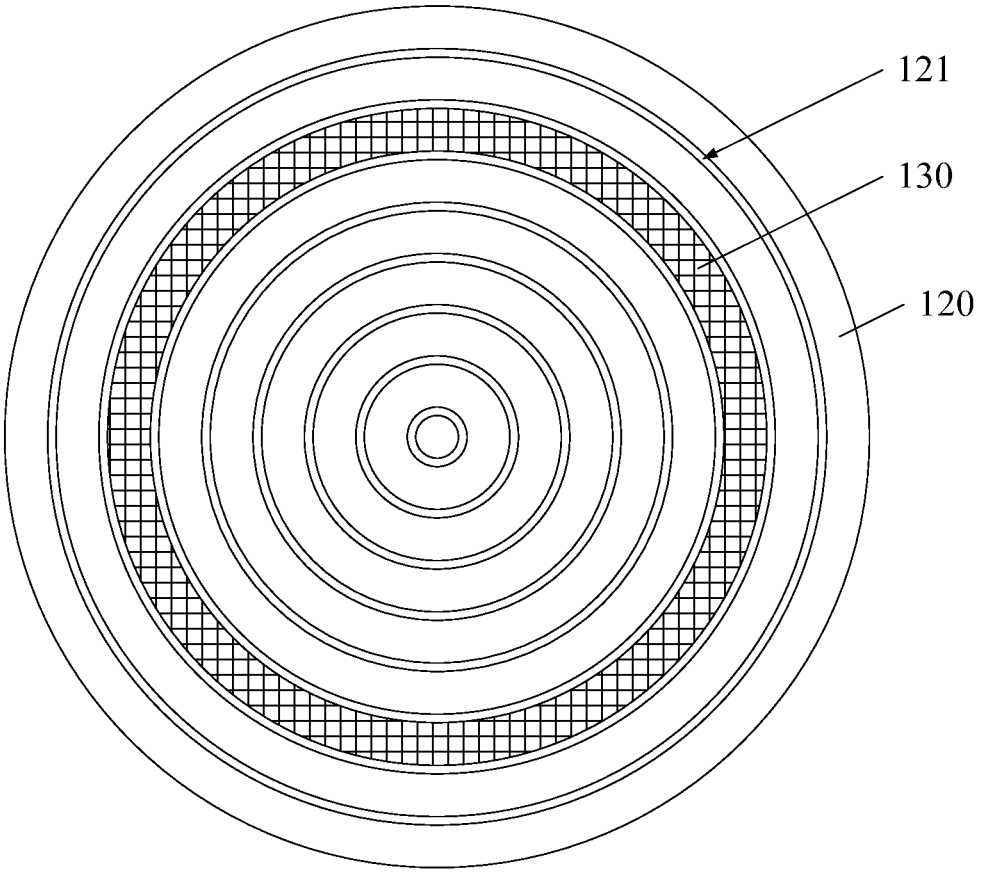

FIG. 4 shows a top-view of the structure shown in FIG. 3 along the A direction.

Further, during the polishing process, the polishing pad may cover the surface of the polishing head of the polishing equipment. The polishing head and the polishing pad may be rotated at a preset spin speed and the rotation axis of the bottom layer 110 (referring to FIG. 3) may be perpendicular to the surface of the polishing pad. Therefore, a rotation center may be defined on the polishing pad. Further, the plurality of mark structures 130 may be distributed along a circular ring to ensure the mark structures 130 fully reflecting the consumption level of the entire polishing layer 120. The center of the circular ring may fully overlap with the rotation center.

Figure 5:
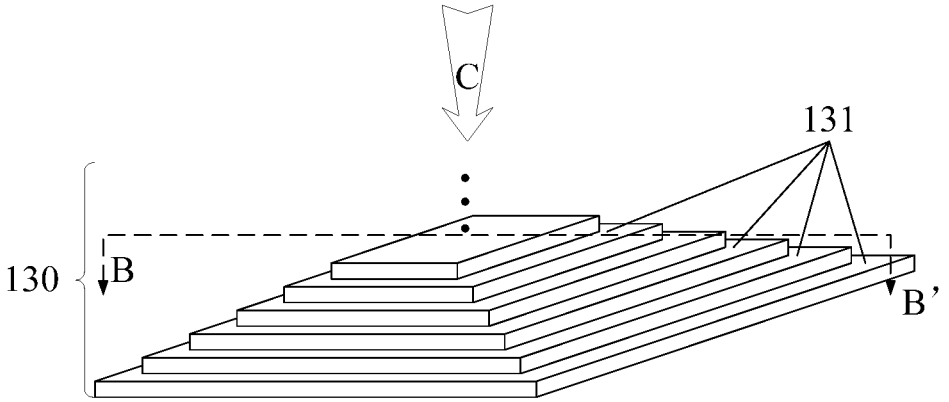
Figure 6:
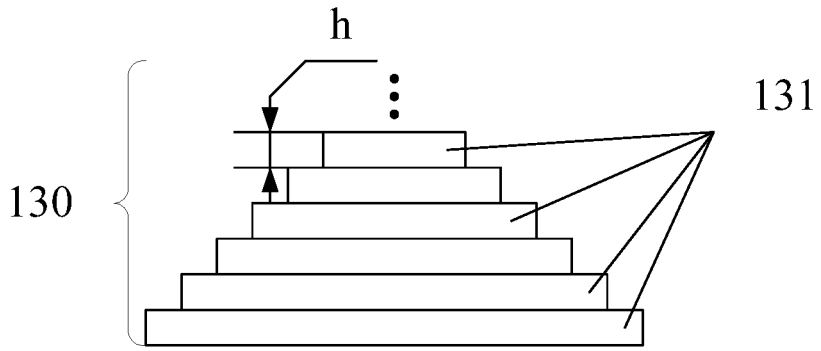
Figure 7:
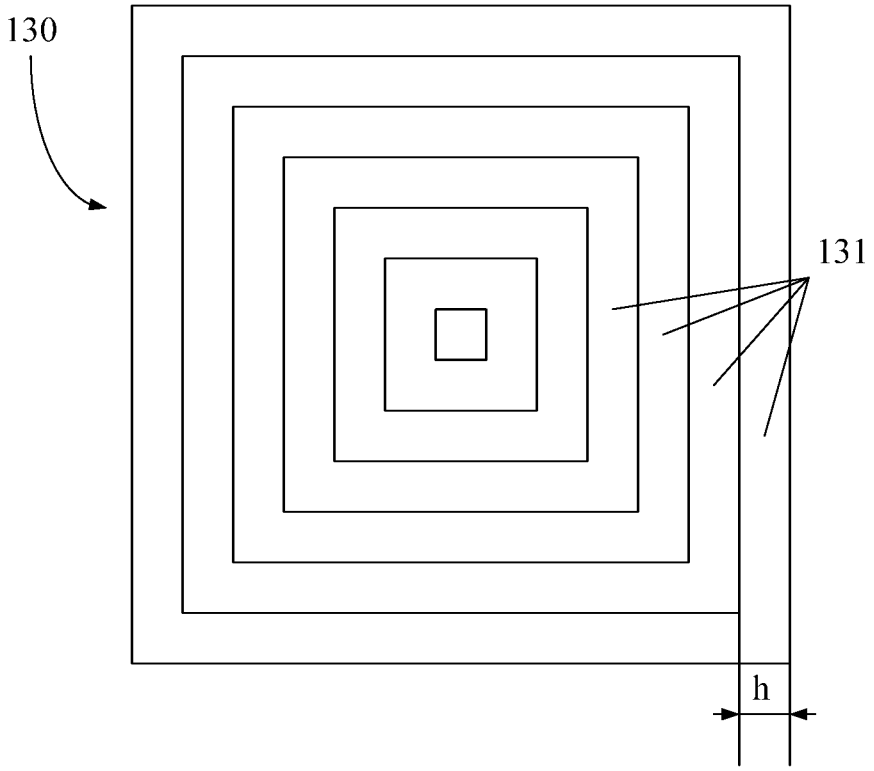

Further, FIG. 5 shows a schematic view of a mark structure 130 shown in FIG. 3. FIG. 6 shows a schematic cross-section view of the mark structure 130 shown in FIG. 5 along a B-B' line. FIG. 7 shows a schematic top view of the mark structure 130 shown in FIG. 5 along a C direction.

Referring to FIGS. 5-7, the mark structure 130 may include a plurality of mark layers 131 formed on the bottom layer 110. The plurality of mark layers 131 may be stacked on each other to form a stacked structure. Specifically, along a direction away from the surface of the bottom layer 110, the areas of the plurality of mark layers 131 may become smaller. In addition, the centers of the plurality of mark layers 131 may project to a same point on the surface of bottom layer 110. As such, the plurality of mark layers 131 of the mark structure 130 may stack together to form a stacked pyramid structure.

Therefore, the profiles of mark layers 131 with different heights may have different sizes. Specifically, when a mark layer 131 is closer to the bottom layer 110, the size of the mark layer 131 may be larger. Thus, when the height of the mark structure 130 becomes reduced during the polishing process, the size of the mark layer 131 at the top surface of the mark structure 130 may simultaneously become larger. Therefore, the height of the mark structure 130 may be obtained based on the size of the top mark layer 131. As such, the remaining height of the polishing layer 120 may also be detected.

In one embodiment, each mark layer 131 may have a simple square shape to reduce challenges in recognizing the profile of the mark layers 131 and also to improve the recognition accuracy. Referring to FIG. 7, the projection of each mark layer 131 on the surface of the bottom layer 110 may be a square. Therefore, the projections of the plurality of mark layers 131 on the surface of the bottom layer 110 may be a series of squares with a same center. Further, by counting the number of the squares, the number of the mark layers 131 may also be obtained, thus the height of the mark structure 130 and then the thickness of the polishing layer 120 may be obtained.

In one embodiment, a gap between the projected edge of an upper-level mark layer 131 on the surface of the bottom layer 130 and the projected edge of a lower-level mark layer 131 on the surface of the bottom layer 130 may be in a range of 1 mm to 10 mm in order to reduce the challenges in counting the number of squares and also to reduce the difficulties in forming the plurality of mark layers 131. In one embodiment, the upper-level mark layer 131 and the lower-level mark layer 131 may be adjacent layers or may be separated by one or more mark layers.

In addition, in one embodiment, the plurality of mark layers 131 may have a same thickness h. Thus, the height of the mark structure 130 may be directly obtained by counting the number of the mark layers 131 in the mark structure 130.

Further, a plurality of trenches 121 may be formed in the polishing layer 120 to redistribute the polishing fluid. During the polishing process, the polishing layer 120 may be consumed while the depth of the trenches 121 may become shallower. The depth of the plurality of trenches 121 may affect the distribution of the polishing fluid on the surface of the polishing pad, thus may further affect the performance of the polishing pad in the polishing process. That is, when the depth of the trenches 121 decreases to a certain value, the polishing pad may be regarded as worn out and the polishing pad may need to be replaced. For illustration purposes, the mark layers 131 are described to have a same thickness or height h. Therefore, the depth of the plurality of trenches 121 may be an integer times of the thickness or height h of each mark layer 131, thus the depth of the trenches 121 may be obtained from the number of the mark layers 131.

Figure 8:
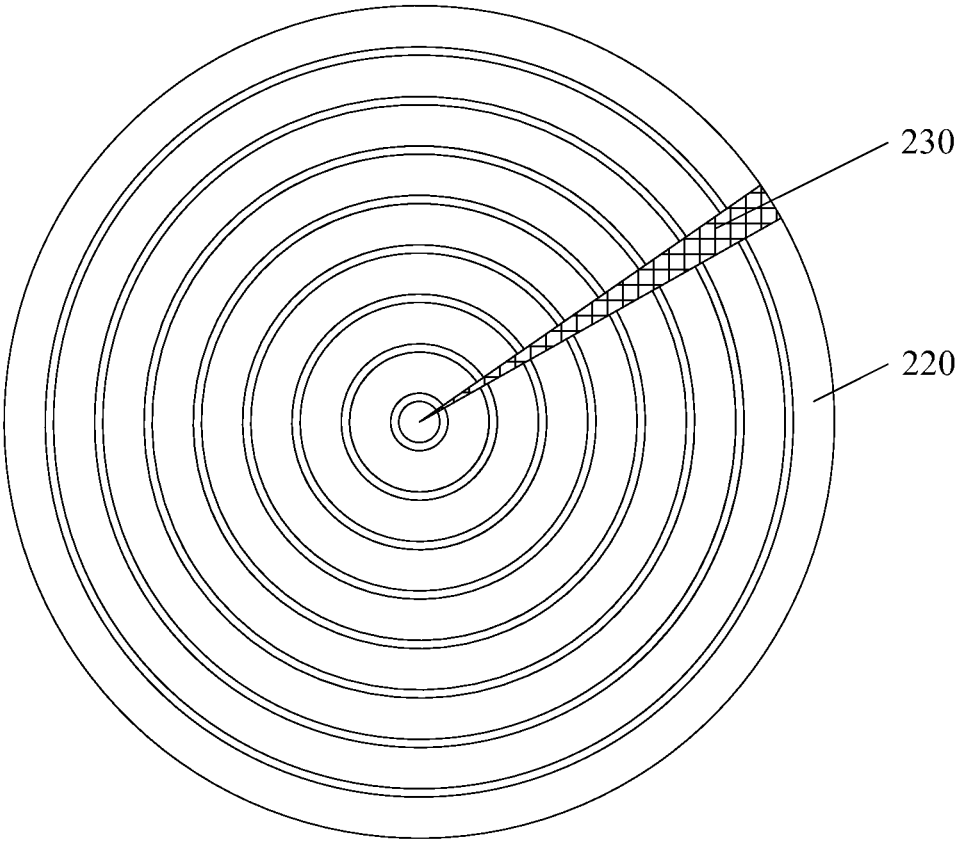
FIGS. 8-10 illustrate schematic views of another exemplary polishing pad consistent with disclosed embodiments.
Figure 9:
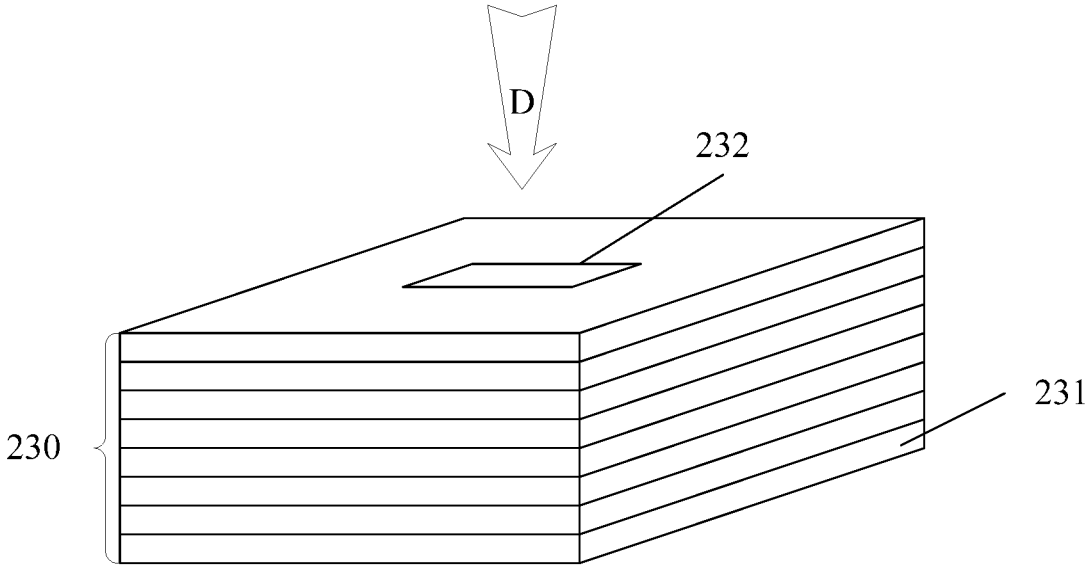
Figure 10:
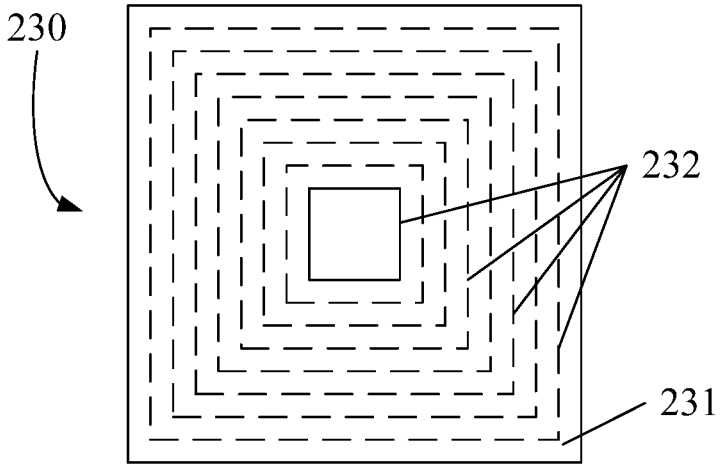

FIGS. 8-10 show schematic views of another polishing pad consistent with various disclosed embodiments.

Referring to FIG. 8, similar to the polishing pad shown in FIGS. 3-7, the polishing pad may include a bottom layer (not shown) and a polishing layer 220. However, different from the polishing pad shown in FIGS. 3-7 where the plurality of mark structures 130 is distributed along a circular ring embedded in the polishing layer 120 (referring to FIG. 3), the polishing pad shown in FIGS. 8-10 may include a plurality of mark structures 230 distributed in a sector region or a fan-shaped region embedded in the polishing layer 220. The center of the arc of the sector region may be the rotation center of the polishing pad. Therefore, the plurality of mark structures 230 distributed in the sector region may reflect the consumption level of the polishing pad at positions with different distances from the rotation center.

In other embodiments, under certain polishing conditions, the surface of the polishing layer in the polishing pad may include a frequently worn region. The frequently worn region on the surface of the polishing layer may be heavily subjected to friction, thus the portion of the polishing layer in the frequently worn region may be consumed faster. Therefore, the plurality of mark structures may also be distributed in the frequently worn region in order to reflect the consumption level of the polishing layer in the frequently worn region.

FIG. 9 shows a schematic view of a mark structure 230 in the polishing pad shown in FIG. 8. FIG. 10 shows a schematic top-view of the mark structure 230 shown in FIG. 9.

Referring to FIG. 9 and FIG. 10, each mark structure 230 may further include a plurality of mark layers 231. The plurality of mark layers 231 may stack on each other to form a stacked structure. However, distinct from the plurality of mark layers 131 shown in FIGS. 4-7 where the areas of the mark layers become smaller along the direction away from the surface of the bottom layer, the plurality of mark layers 231 shown in FIG. 9 and FIG. 10 may all have a same area size. Further, a mark pattern 232 may be disposed on each mark layer 231 and the mark pattern 232 may be used to indicate the height of the mark structure 230.

In one embodiment, the shapes of the plurality of mark patterns 232 may be identical. However, along a direction away from the bottom layer (not shown) of the polishing pad, the areas and the dimensions of the plurality of mark patterns 232 formed on different levels of the mark layers 231 may become smaller. Therefore, by recognizing the area size of a mark pattern 232 on a corresponding mark layer 231 in a mark structure 230, the height of the corresponding mark layer 231 in the mark structure 230 may be obtained, thus the height of the remaining portion of the mark structure 230 may also be determined.

Specifically, in one embodiment, each mark pattern may be a square and the center points of the plurality of mark patterns formed on the plurality of mark layers 231 may project to a same point on the bottom layer (not shown). Therefore, referring to FIG. 10, the mark patterns 232 may be a series of embedded squares. In FIG. 10, only the edges of the mark pattern 232 of the top mark layer 231 may be actually visible, thus the mark pattern 232 of the top mark layer 231 is illustrated by solid lines; in the meantime, the edges of other mark patterns 232 disposed on non-top mark layers 231 may not be visible, thus the edges of such mark patterns 232 are shown in dashed lines.

In one embodiment, on the surface of the bottom layer of the polishing pad, a gap between the projected edge of the mark pattern 232 of an upper-level mark layer 231 and the projected edge of the mark pattern 232 of a lower-level mark layer 231 may be in a range of 1 mm to 10 mm in order to reduce the difficulties in recognizing the mark patterns 232. In one embodiment, the upper-level mark layer 231 and the lower-level mark layer 231 may be adjacent layers or may be separated by one or more mark layers.

The present disclosure also provides a method for monitoring the polishing pad described above during chemical mechanical polishing process. During a polishing process using a disclosed polishing pad, a plurality of mark patterns corresponding to a plurality of mark structures may be acquired.

In one embodiment, the mark structures may have a stacked pyramid structure. Therefore, the mark patterns may be the projected patterns of the mark structures on the surface of the bottom layer of the polishing pad, i.e., the outline profiles of the mark layers that form the mark structure.

In one embodiment, the mark patterns may be directly obtained through a laser scanning method. Specifically, a laser beam generated by a laser may be illuminated on the surface of the mark structure. Further, a reflected light beam from the surface of the mark structure may then be sent to a sensor. The sensor may detect and collect the reflected light signals so that the mark patterns of a plurality of mark structures may be obtained.

Using the laser scanning method to directly obtain mark patterns is an example for acquiring information of the mark patterns. In other embodiments, an image sensor may be used to capture images of the mark structures and the mark patterns may then be extracted from the obtained images of the mark structures.

Specifically, the images of the mark structures may be acquired through an image sensor; then, the mark patterns may be obtained based on the images of the mark structures. A barcode recognition method may be used to extract the mark patterns from the images of the mark structures.

Further, acquisition of the mark patterns of a plurality of mark structures may include acquiring mark patterns of a plurality of mark structures in real time during the chemical mechanical polishing process. Specifically, in one embodiment, a laser scanning system may continuously scan the surface of the polishing pad with a certain time interval to obtain mark patterns of the mark structures. Therefore, during the performance of the polishing process, the consumption level of the polishing pad may be dynamically obtained.

Further, each acquired mark pattern may be compared to a pre-stored critical pattern to obtain the consumption level of the polishing pad in the region adjacent to the mark structure corresponding to the obtained mark pattern. The critical graph may be identical to the mark pattern of the mark structure when the polishing pad is worn out.

In one embodiment, based on the requirement of polishing process and the specific parameters of the polishing pad, the critical pattern may be predefined as an expected mark pattern for a corresponding mark structure when the polishing pad is worn out. Then, the acquired mark pattern on a mark structure may be compared to the corresponding critical pattern to further determine the consumption level of the polishing pad in the region adjacent to the mark structure. Specifically, when the obtained mark pattern is identical to the critical pattern, the polishing pad in the region adjacent to the mark structure may be worn out.

In one embodiment, the acquisition of mark patterns is in real time, thus after the acquisition of each mark pattern, the mark pattern is compared to the corresponding critical graph in real time. The comparison of the mark pattern and the pre-stored critical pattern may include comparing the mark pattern with the critical pattern in real time and then determining the consumption level of the polishing layer. That is, after acquiring the mark pattern using the laser scanning system, the obtained mark pattern may be immediately compared to the corresponding critical pattern to determine the consumption level of the polishing pad. As such, the consumption level of the polishing pad may be monitored in real time during the performance of the polishing process.

When a mark pattern is identical to the critical pattern, the polishing pad is then determined to be worn out in the region adjacent to the mark structure corresponding to the mark pattern. In the meantime, the number of times that mark patterns match with the corresponding critical pattern may be counted. Specifically, when a polishing pad is used for polishing, the total number of times that the obtained mark patterns matching with the critical pattern may be counted from an initial value of zero. Further, the counting number may add one for each time that an obtained mark pattern matches with the corresponding critical pattern. When the total number of times that the obtained mark patterns match the critical pattern reaches a preset value, the polishing pad may be regarded as worn out and thus may need to be replaced.

In one embodiment, when the obtained mark patterns are compared to the pre-stored critical patterns, the number of the obtained mark patterns that are identical to the corresponding critical patterns may be counted. A larger counting number, i.e. more mark patterns are found to be identical to the corresponding critical patterns, may represent a larger worn out region in the polishing layer of the polishing pad. When the counting number reaches a preset value, the worn region of the polishing layer may start to affect the performance of the polishing process, thus the polishing pad may need to be replaced.

Figure 11:
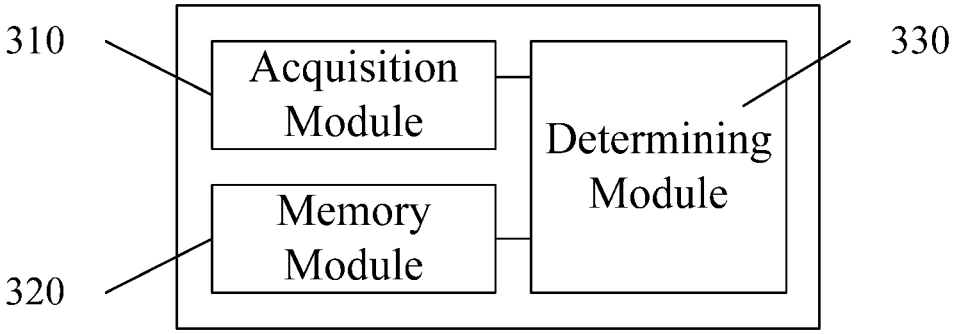
FIGS. 11 and 12 illustrate schematic functional block diagrams of an exemplary monitoring system for monitoring polishing pads consistent with various disclosed embodiments.

The present disclosure also provides a monitoring system for monitoring the polishing pad described above. FIG. 11 shows a schematic functional block diagram of an exemplary monitoring system for monitoring polishing pads consistent with various disclosed embodiments.

Referring to FIG. 11, the monitoring system may include an acquisition module 310 to obtain a plurality of mark patterns. In one embodiment, the acquisition module 310 may be a laser scanning system. Specifically, a laser beam generated by a laser may be illuminated on the surface of the mark structure. Further, a reflected light beam reflected from the surface of the mark structure may then be sent to a sensor. The sensor may detect and collect the reflected light signals and then mark patterns may be obtained based on the intensity of the reflected light signals.

Using the laser scanning method to directly obtain the mark pattern is an example for acquiring mark pattern. In other embodiments, an image sensor may be used to capture images of the mark structure and the mark patterns may then be extracted from the obtained images of the mark structure.

The monitoring system may also include a memory module 320. The memory module 320 may be used to store predefined critical patterns and a preset value. Specifically, each critical pattern may be identical to the corresponding mark pattern when the polishing pad is worn out. The preset value may be the total number of times that mark patterns have matched with the corresponding critical pattern when the polishing pad needs to be replaced.

In one embodiment, prior to actually performing the polishing process, a plurality of mark patterns of the mark structures corresponding to a worn-out polishing layer may be experimentally obtained. The obtained mark patterns for the plurality of mark structures may then be stored in the memory module 320. In the meantime, when the polishing pad needs to be replaced, the total number of worn-out mark structures may be counted and then the counting number may be stored in the memory module 320 as a preset value.

The monitoring system may further include a determining module 330. Referring to FIG. 11, the determining module 330 may be connected to both the acquisition module 310 and the memory module 320 in the block diagram. The determining module 330 may be used to compare the obtained mark pattern with the critical pattern. In addition, the determining module 330 may also be used to compare the preset value with the number of mark patterns that match with the corresponding critical patterns. Further, when the number of mark patterns matching with corresponding critical patterns reaches the preset value, the determining module 330 may indicate that the polishing pad needs to be replaced.

Figure 12:
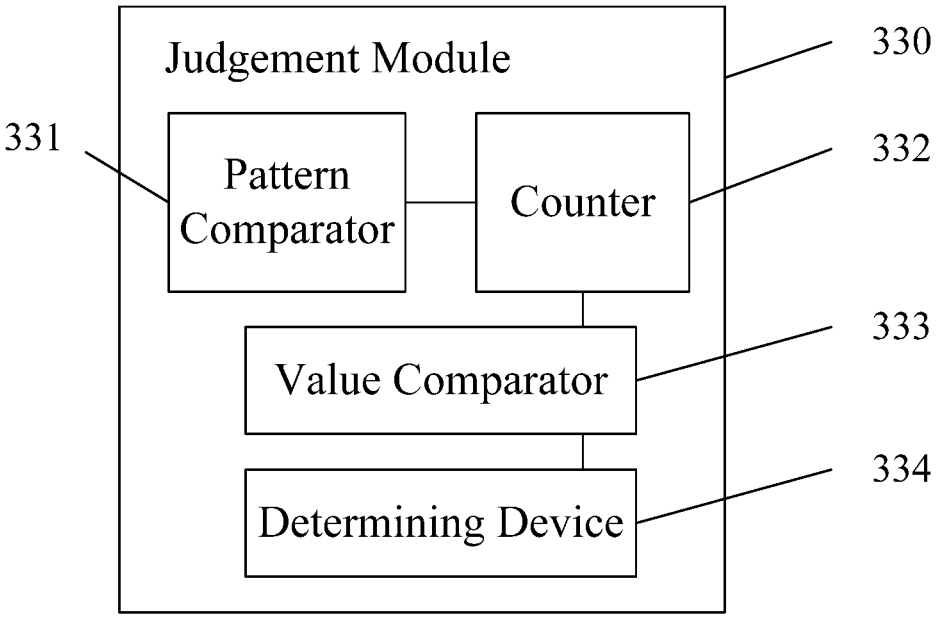

FIG. 12 shows a detailed block diagram for the determining module 330 shown in FIG. 11.

Referring to FIG. 12, the determining module 330 may include a pattern comparator 331. The pattern comparator 331 may be used to compare the mark patterns to the critical patterns. The pattern comparator 331 may be connected to the acquisition module 310 (referring to FIG. 11) to acquire mark patterns obtained by the acquisition module 310. The pattern comparator 331 may also be connected to the memory module 320 (referring to FIG. 11) to read the critical patterns stored in the memory module 320. Further, the pattern comparator 331 may compare the obtained mark patterns with the corresponding critical patterns and then may sent out comparison results.

Returning to FIG. 12, the determining module 330 may include a counter 332. The counter 332 may be connected to the pattern comparator 331 to count and record the results of the pattern comparator 331. Specifically, when a mark pattern matches with the corresponding critical pattern, the counting number in the counter 332 may be added by one. That is, the counter 332 may count the number of times that the obtained mark patterns match with the corresponding critical patterns.

Further, referring to FIG. 12, the determining module 330 may also include a value comparator 333 and a determining device 334. The value comparator 333 may be used to compare the preset value with the number of times that mark patterns match with the corresponding critical patterns. Specifically, the value comparator 333 may be connected to the counter 332 to obtain the counting result from the counter 332. The value comparator 333 may also be connected to the memory module 320 to read the preset value stored in the memory module 320. Moreover, the value comparator 333 may also be used to compare the counting number with the preset value. That is, the value comparator 333 may be used to compare the number of the obtained mark patterns that match with corresponding critical patterns with the preset value.

The determining device 334 may be used to determine whether the polishing pad needs to be replaced. Specifically, the determining device 334 may be connected to the value comparator 333 to receive the comparison results obtained in the value comparator 333. When the counting number is greater than the preset value, the polishing pad then needs to be replaced. That is, when the number of the obtained mark patterns that match with corresponding critical patterns is greater than or equal to the preset value, the determining device 334 may indicate that the polishing pad may need to be replaced.

According to the disclosed monitoring method and monitoring system, the consumption level of the polishing pad may be indicated by a plurality of mark structures inlaid into a polishing layer on the surface of a bottom layer. During a chemical mechanical polishing process, mark patterns of the plurality of mark structures may be obtained. Further, the consumption level of the polishing layer may be determined through the comparison between the mark patterns and the critical patterns. Specifically, when a mark pattern is identical to the critical pattern, the corresponding mark structure is regarded as worn out. Moreover, when the number of the worn-out mark structures reaches a preset value, the polishing pad may need to be replaced. The present disclosure provides a real time monitoring method for inspecting the consumption level of a polishing pad. The present disclosure also provides a proper determination on whether a polishing pad needs to be replaced based on precise determination of the consumption level of the polishing pad. Therefore, the accuracy in estimating the service lifetime of the polishing pad may be improved, the quality of polishing on the wafer surface may be improved, and the yield of device manufacturing may also be improved.

According to the disclosed embodiments, the surface of a plurality of mark structures may be leveled with the surface of the polishing layer. The plurality of mark structures may be made of a same material as the polishing layer. Therefore, consumption of the mark structures during the polishing process may be identical to the consumption of the polishing layer. Moreover, each mark structure may have a stacked structure formed by a plurality of mark layers. The plurality of mark layers may all have a same thickness and a mark pattern may be disposed on each mark layer. Thus, the consumption level of the polishing layer may be directly obtained based on mark patterns. As such, the disclosed polishing pad, monitoring method, and monitoring system may reduce the difficulties in determining the consumption level of the polishing layer and improve the accuracy in estimating the service lifetime of the polishing pad.

Further, according to disclosed embodiments, square mark layers or square mark patterns may be used. In addition, mark patterns may be obtained through a pattern recognition method or an image recognition method. Therefore, the present disclosure may reduce the difficulties in recognizing mark patterns, and may also reduce manufacturing cost for the monitoring system.

Moreover, according to the present disclosure, mark patterns of a plurality of mark structures may be monitored in real time. Further, comparison between obtained mark patterns and predefined critical patterns may also be performed in real time to dynamically obtain the consumption level of the polishing layer. Therefore, monitoring the service condition of the polishing pad in real time may be realized. As such, the procedure to set service lifetime for the polishing pad may be improved, the polishing quality of wafer may be improved, and the yield of device manufacturing may also be improved.

The above detailed descriptions only illustrate certain exemplary embodiments of the present invention, and are not intended to limit the scope of the present invention. Those skilled in the art can understand the specification as whole and technical features in the various embodiments can be combined into other embodiments understandable to those persons of ordinary skill in the art. Any equivalent or modification thereof, without departing from the spirit and principle of the present invention, falls within the true scope of the present invention.

What is claimed is:

1. A method for monitoring a polishing pad, comprising:

providing a polishing pad including a polishing layer disposed on a bottom layer, and a plurality of mark structures disposed on the bottom layer and in the polishing layer to have a top surface coplanar with the polishing layer to indicate a consumption level of the polishing layer, wherein the plurality of mark structures are configured to include mark patterns, each mark structure includes a plurality of mark layers stacked one over another to form a stacked structure, and a size of each mark layer in each mark structure becomes smaller along a direction away from a surface of the bottom layer;

acquiring label graphs of a plurality of label structures;

comparing each mark pattern with a pre-stored critical pattern to obtain the consumption level of the polishing layer in a region adjacent to the mark structure corresponding to the mark pattern, wherein the critical pattern is the mark pattern of a corresponding mark structure when the polishing layer is worn;

recognizing that the polishing layer adjacent to a mark structure is worn every time when the mark pattern is identical to the corresponding critical pattern, and also adding one into a counting number, wherein the counting number is used to count the times that mark patterns match with corresponding critical patterns; and recognizing that the polishing pad needs to be replaced when the counting number reaches a preset value.

2. The method according to claim 1, wherein:

a step of acquiring mark patterns of the plurality of mark structures includes acquiring the mark patterns of the plurality of mark structures in real time during a chemical mechanical polishing process using the polishing pad; and a step of comparing each mark pattern with the corresponding critical pattern includes comparing the mark pattern with the critical pattern in real time and then determining the consumption level of the polishing layer.

3. The method according to claim 1, wherein acquisition of mark patterns of the plurality of mark structures is realized by using a laser scanning method to obtain the mark patterns, or using an image sensor to obtain images of the mark structures and then extracting the mark patterns based on the images of the mark structures.

4. The method according to claim 3, wherein extracting mark patterns based on the images of the mark structures is realized using a barcode recognition method to extract the mark patterns from the images of the mark structures.

5. The method according to claim 1, wherein the plurality of mark structures and the polishing layer are made of a same material.

6. The method according to claim 5, wherein the mark layers in each mark structure have a same thickness.

7. The method according to claim 5, wherein a shape of each mark layer is a square.

8. The method according to claim 5, wherein a center point of each mark layer in each mark structure projects to a same point on the bottom layer.

9. The method according to claim 1, wherein on the surface of the bottom layer, a gap between a projection of an upper-level mark layer and a projection of a lower-level mark layer adjacent to the upper -level mark layer is in a range of 1 mm to 10 mm.

10. The method according to claim 1, wherein the mark layers in each mark structure have an identical area size, and each mark pattern is disposed on each mark layer.

11. The method according to claim 10, wherein the mark patterns of different mark layers have a same shape, and the same shape comprises a square.

12. The method according to claim 10, wherein at least one of an area or a size of each mark pattern of the plurality of mark layers becomes smaller along a direction away from the surface of the bottom layer.

13. The method according to claim 1, wherein the plurality of mark structures is disposed along a circular ring with a center overlapping with the rotation center or disposed as a sector region connecting to the rotation center.

14. A monitoring system for monitoring a polishing pad, comprising:

an acquisition module used to acquire mark patterns of a plurality of mark structures, wherein the polishing pad includes a polishing layer disposed on a bottom layer, and the plurality of mark structures disposed on the bottom layer and in the polishing layer to have a top surface coplanar with the polishing layer to indicate a consumption level of the polishing layer, wherein the plurality of mark structures are configured to include mark patterns, each mark structure includes a plurality of mark layers stacked one over another to form a stacked structure, and a size of each mark layer in each mark structure becomes smaller along a direction away from a surface of the bottom layer;

a memory module used to store critical patterns and a preset value, wherein each critical pattern of the critical patterns is the mark pattern of the corresponding mark structure when the polishing pad is worn while the preset value is the number of times that mark patterns match with the corresponding critical patterns when the polishing pad is worn; and a determining module connected to the acquisition module and the memory module, wherein the determining module, together with the acquisition module and the memory module, are configured to compare the acquired mark patterns with the corresponding critical patterns, calculate the number of times that the critical patterns match the mark patterns, compare the preset value with the number of times that the critical patterns match with the mark patterns, and further recognize that the polishing pad needs to be replaced when the number of times that the critical patterns match with the mark patterns reaches the preset value.

15. The system according to claim 14, wherein the plurality of mark structures and the polishing layer are made of a same material.

16. The system according to claim 15, wherein the mark layers in each mark structure have a same thickness and a shape of each mark layer comprises a square.

17. The system according to claim 15, wherein a center point of each mark layer in each mark structure projects to a same point on the bottom layer.

18. The system according to claim 14, wherein on the surface of the bottom layer, a gap between a projection of an upper-level mark layer and a projection of a lower-level mark layer adjacent to the upper -level mark layer is in a range of 1 mm to 10 mm.

19. The system according to claim 14, wherein the mark layers in each mark structure have an identical area size, and a mark pattern is disposed on each mark layer.

20. The system according to claim 14, wherein the plurality of mark structures is disposed along a circular ring with a center overlapping with the rotation center or disposed as a sector region connecting to the rotation center.

* * * * *